US007288037B2

(12) United States Patent
Myers

(10) Patent No.: US 7,288,037 B2
(45) Date of Patent: Oct. 30, 2007

(54) TOY FOOTBALL AND METHOD THEREFOR

(76) Inventor: Jeffrey D. Myers, 7084 E. Indian School Rd., Scottsdale, AZ (US) 85251

( * ) Notice: Subject to any disclaimer, the term of this patent is extended or adjusted under 35 U.S.C. 154(b) by 0 days.

(21) Appl. No.: 11/193,760

(22) Filed: Jul. 29, 2005

(65) Prior Publication Data

US 2006/0025254 A1 Feb. 2, 2006

Related U.S. Application Data

(60) Provisional application No. 60/592,625, filed on Jul. 30, 2004.

(51) Int. Cl.
*A63B 43/00* (2006.01)

(52) U.S. Cl. ..... 473/613; 473/570

(58) Field of Classification Search ..... 473/613, 473/614, 570, 571, 575, 576, 595; 446/36; D21/712

See application file for complete search history.

(56) References Cited

U.S. PATENT DOCUMENTS

| | | | | |
|---|---|---|---|---|
| 1,629,364 | A | 5/1927 | Scholly | |
| 3,225,488 | A | 12/1965 | Goldfarb | |
| 3,428,321 | A | 2/1969 | Manning | |
| 5,458,329 | A * | 10/1995 | Bushman et al. | 473/613 |
| 5,779,576 | A | 7/1998 | Smith, III et al. | |
| 5,807,198 | A * | 9/1998 | Grimm | 473/613 |
| 6,010,419 | A * | 1/2000 | Rappaport et al. | 473/613 |
| 6,042,494 | A * | 3/2000 | Rappaport et al. | 473/613 |
| 6,120,398 | A | 9/2000 | Myers | |
| 6,695,728 | B1 * | 2/2004 | Eddins | 473/613 |
| 6,997,828 | B1 * | 2/2006 | Yang | 473/590 |
| 2001/0039221 | A1 * | 11/2001 | Schneider | 473/614 |
| 2003/0027672 | A1 * | 2/2003 | Leal et al. | 473/613 |

* cited by examiner

*Primary Examiner*—Steven Wong
(74) *Attorney, Agent, or Firm*—Jeffrey D. Moy; Veronica-Adele R. Cao; Weiss & Moy, P.C.

(57) ABSTRACT

An improved toy football having a plurality of fins dimensioned to stabilize the toy football while in flight, to provide for a controlled throw, and to reduce drag so that the toy football may be thrown farther than prior art toy footballs. An improved toy football for use at night or in areas where there is little light. A method for increasing throwing distance of a toy football.

16 Claims, 4 Drawing Sheets

TOY FOOTBALL AND METHOD THEREFOR

CROSS-REFERENCE TO RELATED APPLICATION

This application claims priority to a corresponding provisional application U.S. Ser. No. 60/592,625, filed Jul. 30, 2004 in the name of the applicant of this application.

BACKGROUND OF THE INVENTION

1. Field of the Invention

This invention relates to toys and, more specifically, to a toy football which has a plurality of fins arranged in a serpentine manner to aid in the flight of the football.

2. Description of the Prior Art

Children of all ages like to play catch with various objects. Children often engage in various games of competition to see who can throw an object the highest, the farthest, and the fastest. Competitions of this nature have been largely ignored by the prior art, as has been the natural curiosity to find out how far and how fast one can throw an object and to measure the improvement.

Many children, and even adults, have a hard time throwing a football. Because of the shape, many people have a difficult time throwing a spiral. Such controlled flights of the toy football are particularly desired during practicing of the forward pass.

Toy footballs are known which employ a tail for guiding the ball during flight. However, none are known which control flight and add to the momentum of the football during flight.

Therefore, a need existed to provide an improved toy football. The improved toy football must overcome the problems associated with prior art toy footballs. The improved toy football must be easier to have a controlled throw and be able to throw farther than prior art toy footballs.

SUMMARY OF THE INVENTION

In accordance with one embodiment of the present invention, it is an object of the present invention to provide an improved toy football.

It is another object of the present invention to provide an improved toy football that overcomes the problems associated with prior art toy footballs.

It is another object of the present invention to provide an improved toy football that is easier to have a controlled throw and is able to be thrown farther than prior art toy footballs.

The foregoing and other objects, features, and advantages of the invention will be apparent from the following, more particular, description of the preferred embodiments of the invention, as illustrated in the accompanying drawing.

BRIEF DESCRIPTION OF THE PREFERRED EMBODIMENTS

In accordance with one embodiment of the present invention, a toy football is disclosed. The toy football comprises an elongated spheroid body section and a tail section coupled to and extending longitudinally from the body section. The tail section comprises a rod member coupled to a back end of the body section and a plurality of fins coupled to and along a length of the rod member in an S-configuration. The plurality of fins are dimensioned to stabilize the body section while in flight and to force the air impacted by the body section downstream on each of the fins sequentially.

In accordance with another embodiment of the present invention, an improved toy football is disclosed. The toy football comprises an elongated spheroid body section and a light circuit for illuminating the toy football. The light circuit comprises at least one light bulb, a power source coupled to the at least one light bulb, and a switch for activating and deactivating the light circuit, the switch being coupled to the at least one light bulb and coupled to the power source. The toy football also comprises a hollow interior defined by the body section and at least one window defined by the body section to allow light from the light circuit to be visible through the at least one window.

In accordance with another embodiment of the present invention, a method for increasing throwing distance of a toy football is disclosed. The method comprises the steps of providing a toy football comprising an elongated spheroid body section and a tail section coupled to and extending longitudinally from the body section. The tail section comprises a rod member rotatably coupled to a back end of the body section and a plurality of fins coupled to and along a length of the rod member in an S-configuration. The method further comprises the steps of throwing the toy football, transferring the air impacted by the body section downstream sequentially on each of the plurality of fins, rotating of the rod member during flight of the toy football, and reducing drag on the toy football by the plurality of rotating fins.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings.

DETAILED DESCRIPTION OF THE PREFERRED EMBODIMENT

Figure 1:
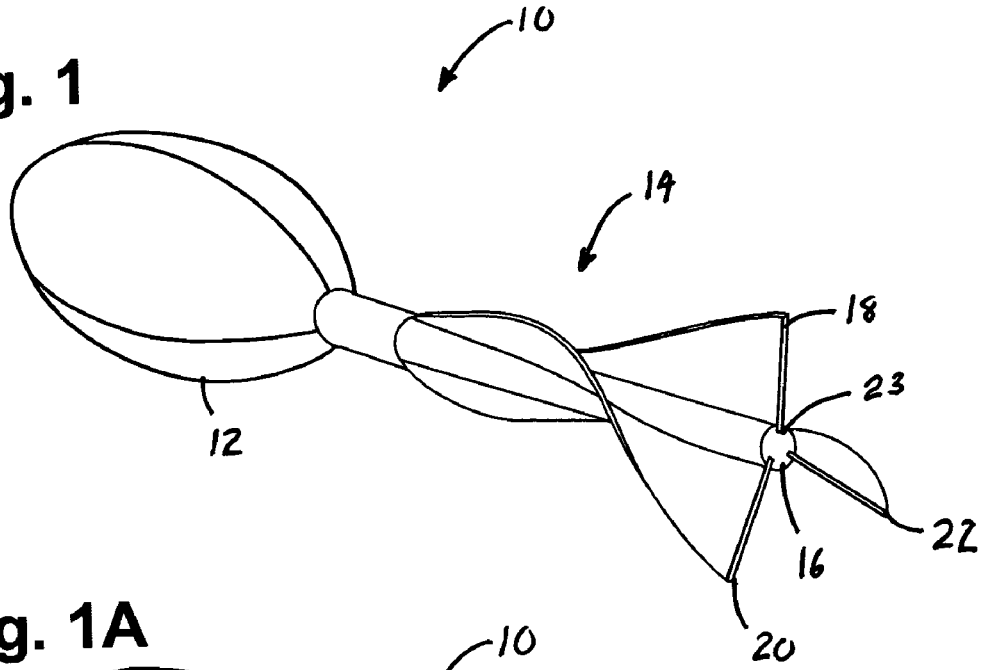
FIG. 1 is an elevated perspective view of the improved toy football of the present invention.

Referring to FIG. 1, a molded foam toy football 10 is shown (hereinafter toy football 10). The toy football 10 is comprised of a body section 12 having a tail section 14. The body section 12 is an elongated spheroid ball. The body section 12 may be made out of different materials. For example, the body section 12 may be a molded solid plastic ball. Alternatively, the body section may be a resilient plastic foam-like material or soft cushion ball. The listing of the above should not be seen as to limit the scope of the present invention.

The body section 12 has a tail section 14 extending longitudinally therefrom. The tail section 14 has a rod member 16. The rod member 16 is coupled to the body section 12. The rod member 16 extends out of a back end of the body section 12. In accordance with one embodiment of the present invention, the rod member 16 is rotatably coupled to the body section 12. The rod member 16 is a light weight and sturdy rod member generally made of plastic, wood, hardened foam, or the like. The listing of the above should not be seen as to limit the scope of the present invention.

A plurality of fins 18, 20, and 22 are coupled to the rod member 16. In the embodiment depicted in FIG. 1, the fins 18-22 run along the length of the rod member 16. The fins 18-22 help to stabilize the body section 12 while in flight thereby allowing the toy football 10 to spiral in the air and travel further. The fins 18-22 forces the air impacted by the body section 12 sequentially on each of the fins 18-22 formed around the tail 12 downstream thereof to its end.

The fins 18-22 are coupled to the rod member 16 in an "S" configuration. The fins 18-22 are each of the same geometrical configuration and are spaced equally along the rod member 16 a like distance apart. Each fin 18-22 travels roughly one-third around the outer circumference of the rod member 16. By placing the fins in an "S" shaped patterns, this helps a spiraling of the body section 12 when the toy football 10 is thrown. Furthermore, if the rod member 16 is rotatably coupled to the body section 12, the "S" shaped patterns of the fins 18-22 will aid in the rotation of the rod member 16 thereby reducing drag on the toy football 10 and allowing the toy football 10 to travel further.

In accordance with one embodiment of the present invention, channels 23 are formed in the rod member 16. The channels 23 are used to stabilize the fins 18-22 and to help secure the fin 18-22 to the rod member 16.

Figure 1A:
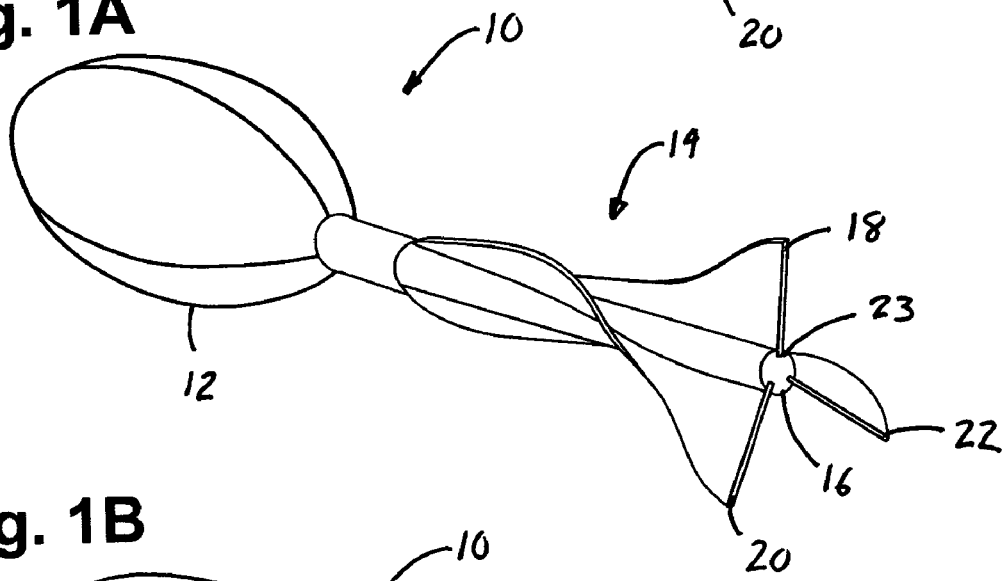
FIG. 1A is an elevated perspective view of the improved toy football of the present invention with a second fin design.
Figure 1B:
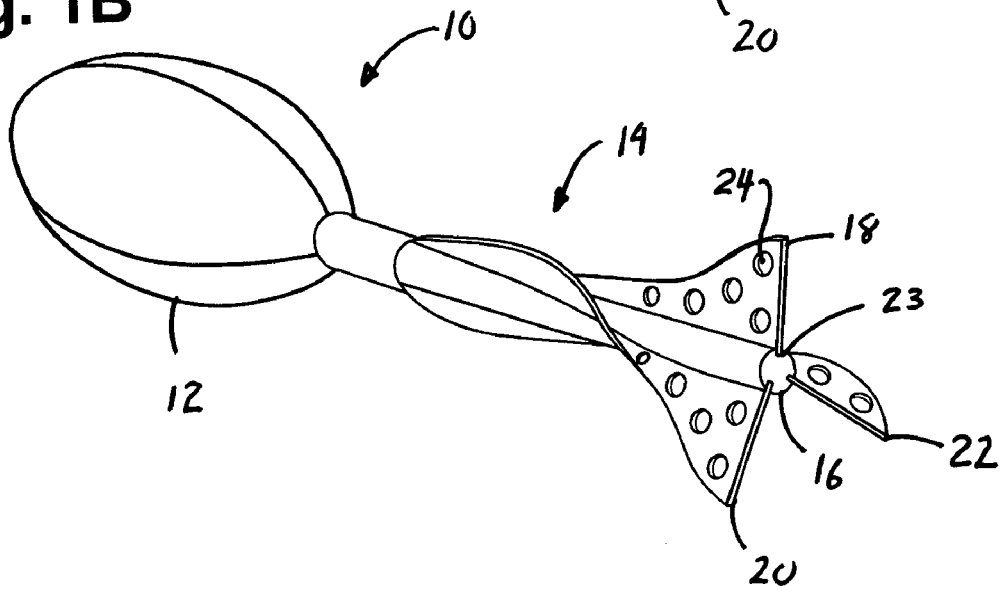
FIG. 1B is an elevated perspective view of the improved toy football of the present invention with a third fin design.
Figure 2:
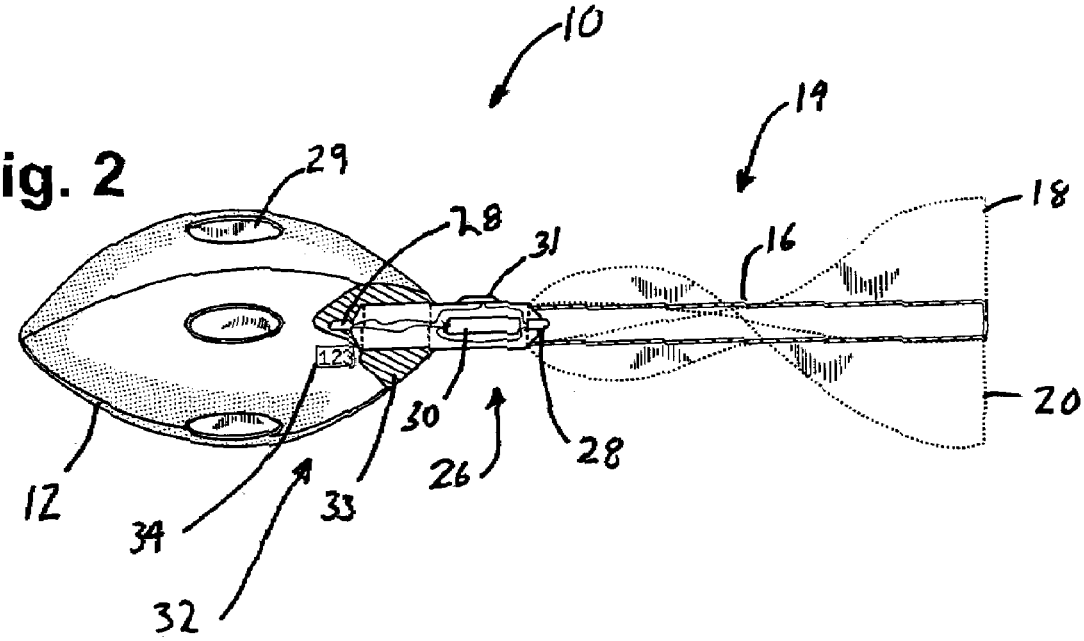
FIG. 2 is an elevated perspective view of a second embodiment of the improved toy football of the present invention. The broken lines indicate that the tail section may be optional.

As stated above, the fins 18-22 are each of the same geometrical configuration. As shown in FIG. 1, each fin 18-22 is triangular in shape. FIG. 1A is similar to that shown in FIG. 1. However, the fins 18-22 in FIG. 2 are slightly curved on the longest side of the triangular shaped fin. FIG. 1B is similar to that shown in FIG. 1A. The main difference being that the fins 18-22 have a plurality of holes 24 formed therein. The holes 24 help to reduce air drag.

Figure 4:
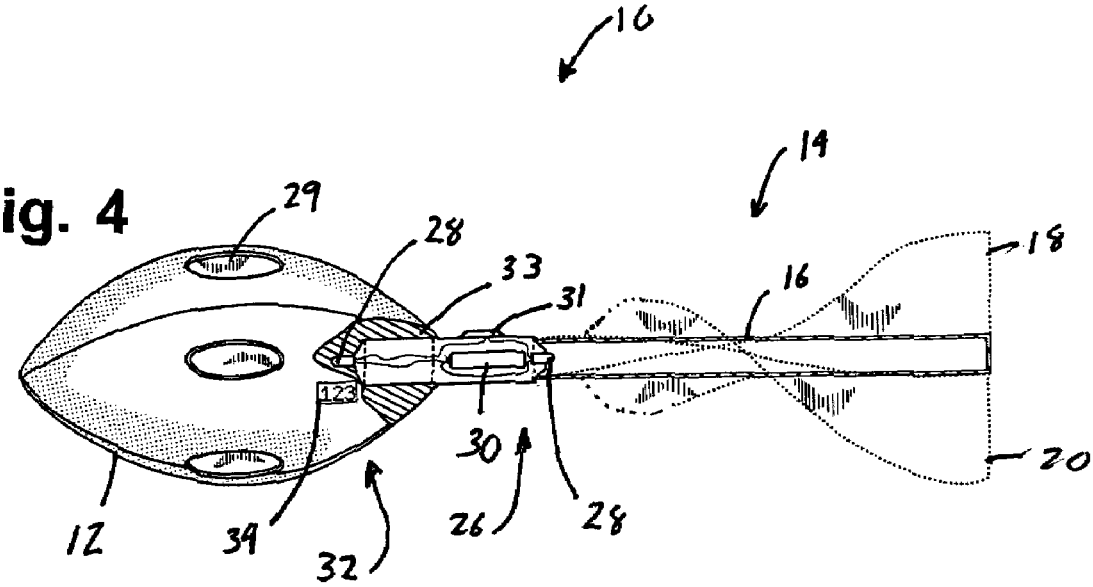
FIG. 4 is an elevated perspective view of a fourth embodiment of the improved toy football of the present invention. The broken lines indicate that the tail section may be optional.

Referring now to FIGS. 2 and 4, the toy football 10 may have a light circuit 26. The light circuit 26 is used to illuminate the toy football 10. This will allow one to see the toy football 10 to be thrown at night or in areas where there is little light. The light circuit 10 is generally comprised of one or more light bulbs 28. The light bulbs 28 may be any type of lighting device. In general, a small lighting device such as an LED is used. However, this should not be seen as to limit the scope of the present invention. The light bulb 28 is coupled to a power source 30. The power source 30 is generally a small battery. A switch 31 is coupled to the power supply and to the light bulb 28 to activate and deactivate the light circuit 26. One or more windows 29 may be formed in the body section 12. The windows 29 will cover a hollow interior section 33 of the body section 12. The light circuit 26 will thus illuminate the hollow interior section 33 and shine through the windows 29.

The broken lines in FIGS. 2 and 4 indicate that the toy football 10 may or may not have a tail section 14. For a toy football 10 that is equipped with a tail section 14, the rod member 16 is preferably made of a transparent material such as a clear/opaque plastic material. This will allow the light from the light circuit 26 to illuminate and shine through the rod member 16. The rod member 16 will extend into the hollow interior section 33 so as to illuminate the hollow interior section 33 and shine through the windows 29 as well.

A counting device 32 may also be coupled to the rod member 16. The counting device 32 will measure the number of revolutions of the rod member 16 when the rod member 16 is rotatably coupled to the body section 12. The counting device 32 will have a display 34 coupled to the body section 12. The display 34 may be any type of display 34. The display 34 may be an analog display having a plurality of numerical wheels or a digital display. The display 34 is coupled to the rod member 16 so that the display 34 may monitor and record the number of rotations.

Figure 3:
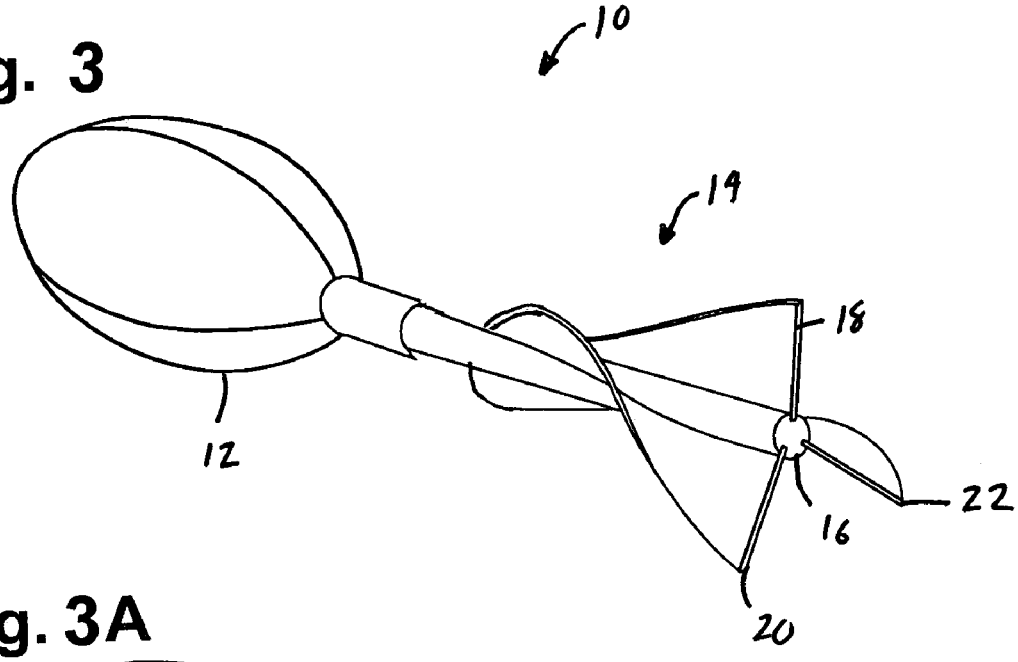
FIG. 3 is an elevated perspective view of a third embodiment of the improved toy football of the present invention.
Figure 3A:
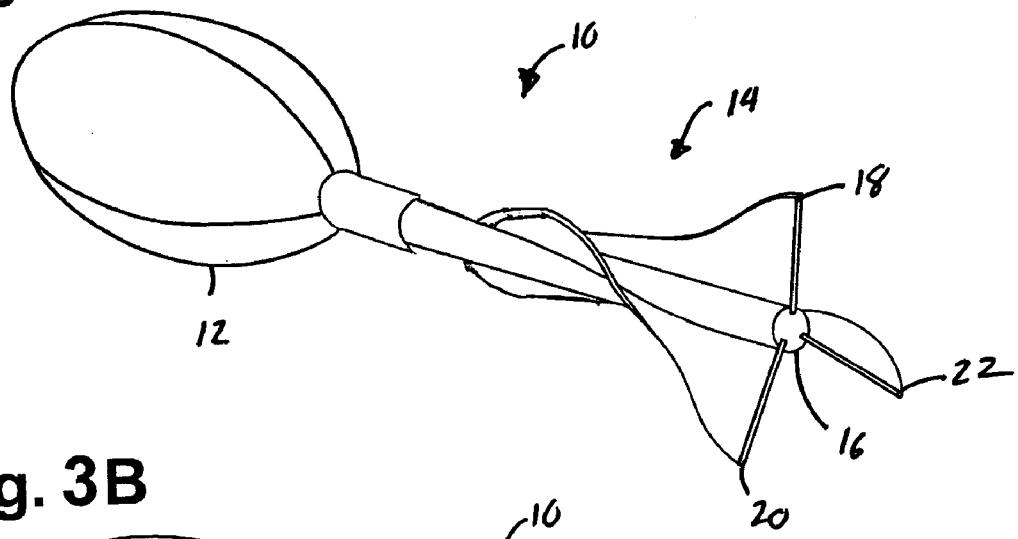
FIG. 3A is an elevated perspective view of the improved toy football of depicted in FIG. 3 with a second fin design.
Figure 3B:
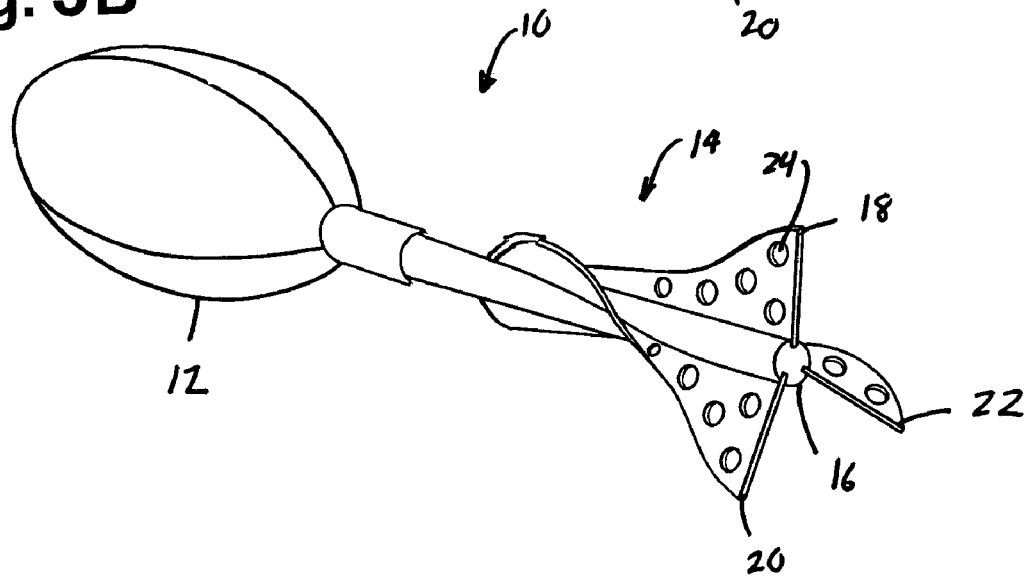
FIG. 3B is an elevated perspective view of the improved toy football depicted in FIG. 3 with a third fin design.

Referring to FIGS. 3-3B and 4, the toy football 10 is shown having a plurality of different fin 18-20 configurations. FIG. 3-3B shows a toy football 10 similar to that shown in FIG. 1-1B. The main difference is that the fins 18-20 shown in FIGS. 3-3B only extend a portion of the way up the rod member 16 instead of all the way up the rod member 16 as shown in FIGS. 1-1B. Likewise, FIG. 4 shows a toy football 10 similar to that shown in FIG. 2. Again, the main difference is that the fins 18-20 depicted in FIG. 4 only extend a portion of the way up the rod member 16 instead of all the way up the rod member 16 as shown in FIG. 2.

While the invention has been particularly shown and described with reference to preferred embodiments thereof, it will be understood by those skilled in the art that the foregoing and other changes in form and details may be made therein without departing from the spirit and scope of the invention.

I claim:

1. A toy football comprising:

an elongated spheroid body section;

a tail section coupled to and extending longitudinally from the body section, the tail section comprising:

a rod member coupled to a back end of the body section; and a plurality of fins coupled to and along a length of the rod member in an S-configuration, the plurality of fins being dimensioned to stabilize the body section while in flight and to force the air impacted by the body section downstream on each of the fins sequentially; and a light circuit for illuminating the toy football, the light source comprising:

at least one light bulb;

a power source coupled to the at least one light bulb; and a switch for activating and deactivating the light circuit, the switch being coupled to the at least one light bulb and coupled to the power source;

wherein the rod member is substantially transparent in order to allow light from the light circuit to be visible through the rod member.

2. The toy football of claim 1 further comprising a plurality of channels defined by the rod member, the plurality of channels dimensioned to secure the plurality of fins to the rod member.

3. The toy football of claim 1 wherein the plurality of fins is of identical geometric configuration.

4. The toy football of claim 1 wherein the plurality of fins is spaced equally along the rod member a like distance apart.

5. The toy football of claim 1 wherein each fin travels approximately one-third around an outer circumference of the rod member.

6. The toy football of claim 1 wherein the plurality of fins is coupled along the entire length of the rod member.

7. The toy football of claim 1 wherein the plurality of fins is coupled along a portion of the length of the rod member.

8. The toy football of claim 1 wherein the rod is rotatably coupled to the body section.

9. The toy football of claim 8 wherein the S-configuration aids the rotation of the rod member thereby reducing drag on the toy football.

10. The toy football of claim 1 wherein each of the fins has a substantially triangular shape.

11. The toy football of claim 10 wherein the longest side of each triangularly shaped fin is slightly curved.

12. The toy football of claim 1 wherein at least one of the fins defines a plurality of holes, the holes being dimensioned to reduce air drag.

13. The toy football of claim 1 wherein the body section defines:

a hollow interior; and at least one window to allow light from the light circuit to be visible through the at least one window.

14. The toy football of claim 8 further comprising a counting device for measuring the number of revolutions of the rod member, the counting device being coupled to the rod member.

15. The toy football of claim 14 wherein the counting device comprises a display coupled to the rod member for indicating the number of revolutions of the rod member.

16. An improved toy football comprising:

an elongated spheroid body section;

a tail section coupled to and extending longitudinally from the body section, the tail section comprising:

a rod member rotatably coupled to a back end of the body section; and a plurality of fins coupled equidistantly to and along a length of the rod member in an S-configuration, each of the fins having:

a substantially triangular shape, the longest side of each the triangularly shaped fin curving approximately one-third around an outer circumference of the rod member; and a plurality of holes defined by each of the fins and dimensioned to reduce air drag; and a plurality of channels defined by the rod member, the plurality of channels dimensioned to secure the plurality of fins to the rod member; and a light circuit for illuminating the toy football, the light source comprising:

at least one light bulb;

a power source coupled to the at least one light bulb; and a switch for activating and deactivating the light circuit, the switch being coupled to the at least one light bulb and coupled to the power source;

wherein the rod member is substantially transparent in order to allow light from the light circuit to be visible through the rod member.

* * * * *